US006516692B1

(12) United States Patent
Hsien

(10) Patent No.: US 6,516,692 B1
(45) Date of Patent: Feb. 11, 2003

(54) PAWL CONTROLLING DEVICE FOR RATCHET TOOLS

(76) Inventor: Chih-Ching Hsien, No. 367, Pei Yang Rd., Feng Yuan, Taichung (TW)

( * ) Notice: Subject to any disclaimer, the term of this patent is extended or adjusted under 35 U.S.C. 154(b) by 0 days.

(21) Appl. No.: 10/195,490

(22) Filed: Jul. 16, 2002

(51) Int. Cl.[7] ..... B25B 13/46
(52) U.S. Cl. ..... 81/63.2; 81/63
(58) Field of Search ..... 81/63.2, 63, 60, 81/61, 62, 63.1

(56) References Cited

U.S. PATENT DOCUMENTS 837,291 A * 12/1906 Elliot ..... 81/63
1,209,320 A * 12/1916 Morneweck ..... 192/43.2
3,436,992 A * 4/1969 Over et al. ..... 81/63.1
5,467,672 A * 11/1995 Ashby ..... 81/58.2
5,533,427 A * 7/1996 Chow ..... 192/43
6,065,374 A * 5/2000 Taggart ..... 81/63
6,382,052 B1 * 5/2002 Chen ..... 81/63
6,386,072 B1 * 5/2002 Yuan-Chin et al. ..... 192/43.2

* cited by examiner

*Primary Examiner*—James G. Smith
*Assistant Examiner*—Hadi Shakeri
(74) *Attorney, Agent, or Firm*—Rosenberg, Klein & Lee

(57) ABSTRACT

A pawl controlling device for a ratchet tool includes a V-shaped spring which is secured to a plate which is movably inserted into a slot of the tool and two distal ends of the spring are respectively engaged with two concavities of a pawl. The pawl is shifted by either of the two distal ends of the spring when moving the plate.

4 Claims, 5 Drawing Sheets

PAWL CONTROLLING DEVICE FOR RATCHET TOOLS

FIELD OF THE INVENTION

The present invention relates to a ratchet tool that has a pawl with two recesses for two ends of a V-shaped spring respectively engaged therewith and the spring is connected to a movable selection member.

BACKGROUND OF THE INVENTION

A conventional pawl control device for shifting the pawl to engage with the teeth of the engaging member in the ratchet tool is located in the tool and cannot be accessed. When the pawl is shifted to one direction, the ratchet tool may output a torque in one direction, vice versa. Generally, the pawl has a protrusion at a rear end thereof and the selection member has a shifting portion which pushes the protrusion and shifts the pawl. The user has to exert a large force to shift the pawl.

The present invention intends to provide a pawl shifting device that uses a V-shaped spring to easily shift the pawl.

SUMMARY OF THE INVENTION

In accordance with one aspect of the present invention, there is provided a ratchet tool that has a head with a hole defined therethrough and a recess is defined in an inner periphery of the hole so as to receive a pawl therein. A slot is defined in a side of the head and communicates with the recess. A notch is defined in an inner periphery of the slot for receiving a bead and a spring therein.

An engaging member is rotatably received in the hole of the head and has a toothed outer periphery which is matched with the pawl. Two concavities are defined in a side of the pawl. A selection member is movably inserted in the slot and a V-shaped spring is secured to the selection member and two distal ends of the spring are respectively engaged with the two concavities.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
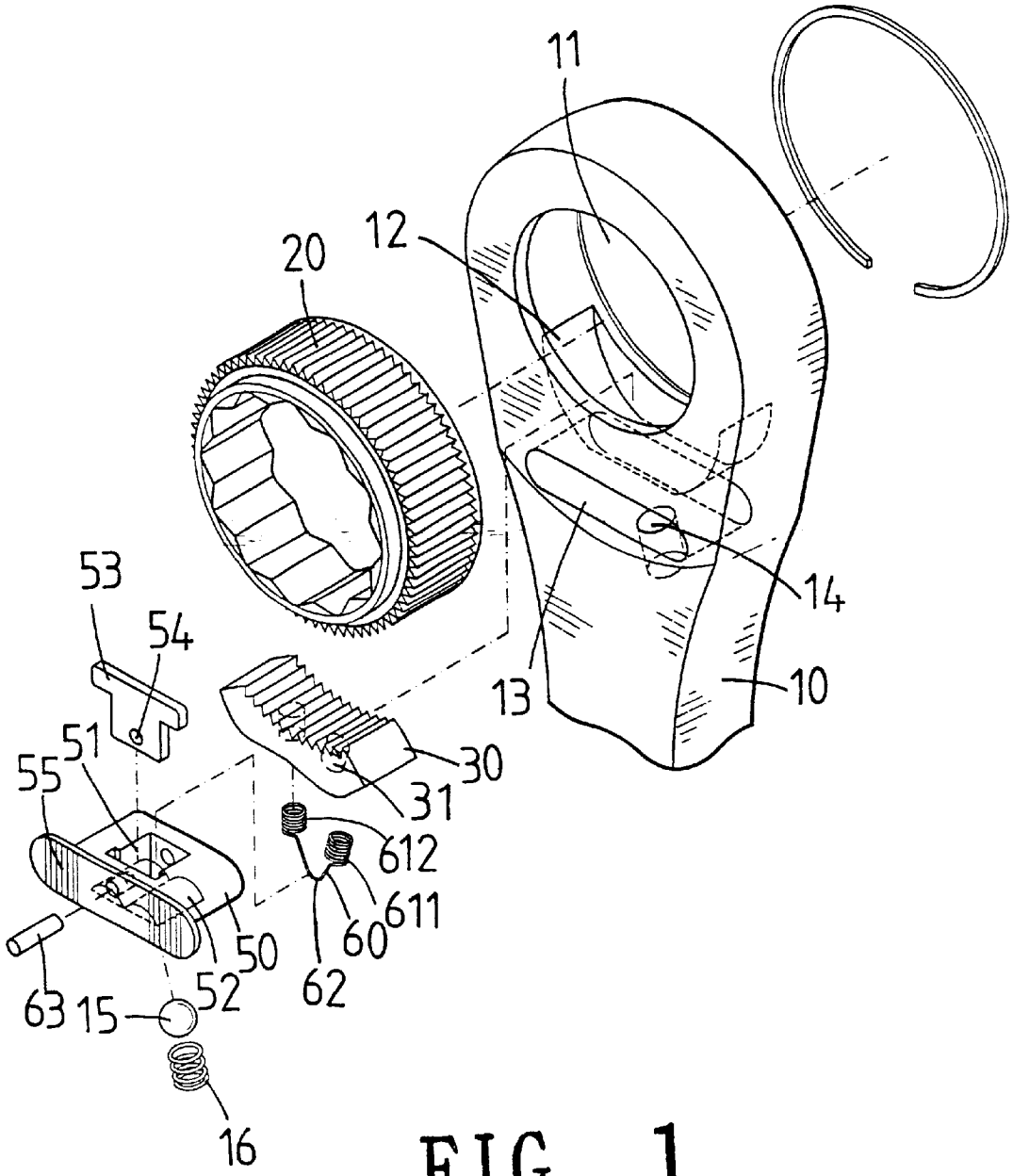
FIG. 1 is an exploded view to show the ratchet tool of the present invention.

Referring to FIGS. 1, 2, 4 and 5, the ratchet tool of the present invention comprises a head 10 having a hole 11 defined therethrough and a shank extends from the head 10.

An engaging member with a toothed outer periphery is rotatably received in the hole 11. A recess 12 is defined in an inner periphery of the hole 11 for receiving a pawl 30 therein. A slot 13 is defined in a side of the head 10 and communicates with the recess 12. A notch 14 is defined in an inner periphery of the slot 13.

The pawl 30 has a toothed surface defined in a first side of the pawl 30 and the toothed surface is matched with the toothed outer periphery of the engaging member 20. Two concavities 31 are defined in a second side of the pawl 30.

A selection member 50 includes a body for being inserted in the slot 13 and a top plate connected to an end of the body. The top plate is located on the side of the tool and includes two knurled portions 55 such that the user may push the top plate at the knurled portions 55 to push the selection member 50 within the slot 13. Two recesses 52 are defined in a side surface of the body of the selection member 50. A bead 15 and a spring 16 are received in the notch 14 so that the bead 15 is engaged with one of the two recesses 52 to position the selection member 50 at one of two operation positions. The selection member 50 has a chamber 51 defined through a side surface opposite to the side surface having the two recesses 52, and a mediate portion 62 of a V-shaped spring 60 is securely received in the chamber 51. Two distal ends 611, 612 of the V-shaped spring 60 are respectively engaged with the two concavities 31. A plate 53 is inserted in the chamber 51 and located in parallel to the V-shaped spring 60. A hole 54 is defined through the plate 53and a pin 63 extends through the top plate, the hole 54 and is engaged with a notch in an inside of the chamber such that the pin 63 is located between the two distal ends 611, 612 to prevent the spring 60 from being disengaged from the chamber 51.

Figure 2:
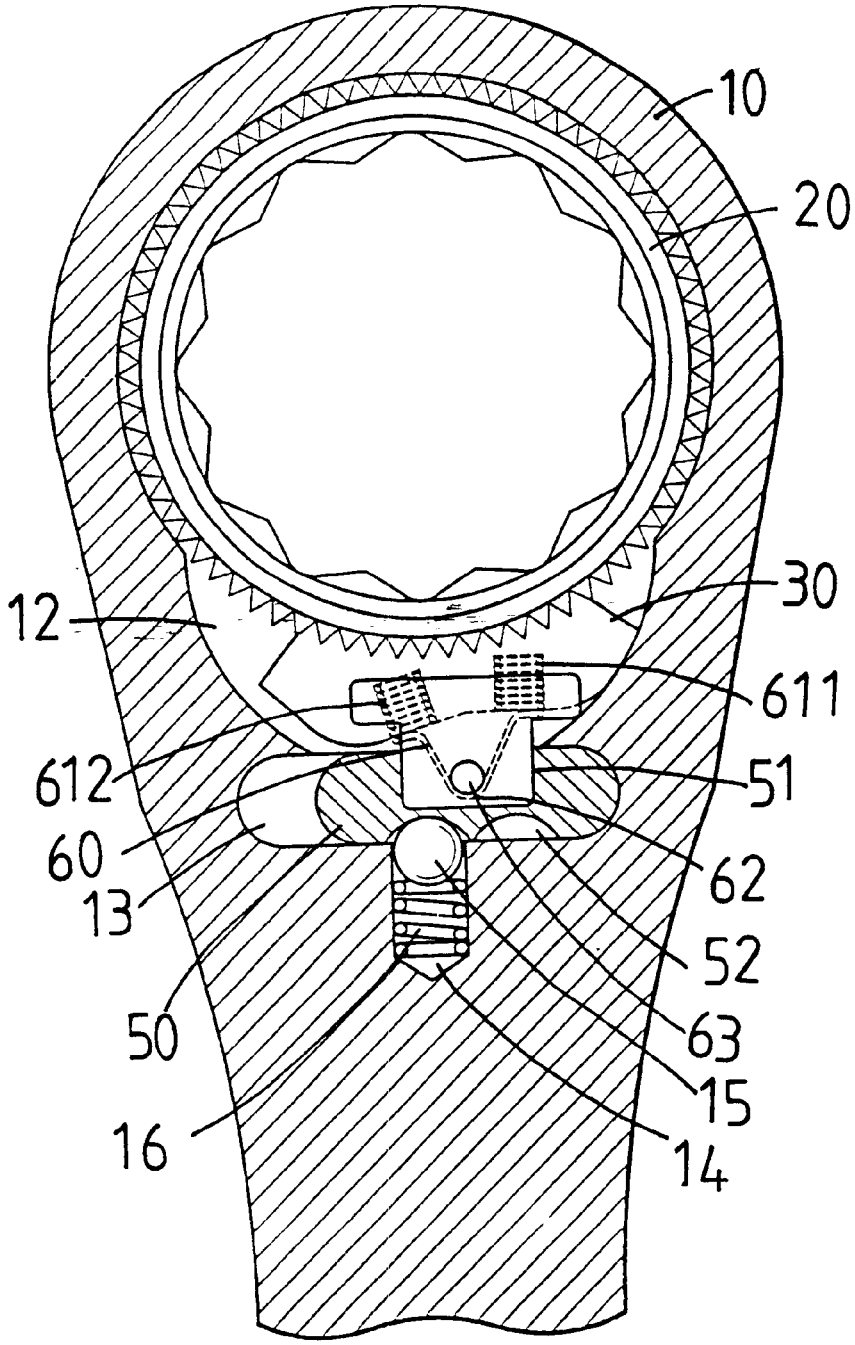
FIG. 2 is a cross sectional view to show the ratchet tool of the present invention, wherein the selection member is moved to the right.

When pushing the selection member 50 to the right as shown in FIG. 2, the bead 15 is pushed inward till it is engaged with the recess 52 on the left in the figure, the distal end 611 of the spring 60 exerts a force to shift the pawl 30 to the right and an end of the pawl 30 contacts against the inside of the recess 12 and the pawl 30 is matched with the toothed outer periphery of the engaging member 20 by the two distal ends 611, 612. Therefore, the ratchet tool may tight or loosen an object when rotating counter clockwise.

Figure 3:
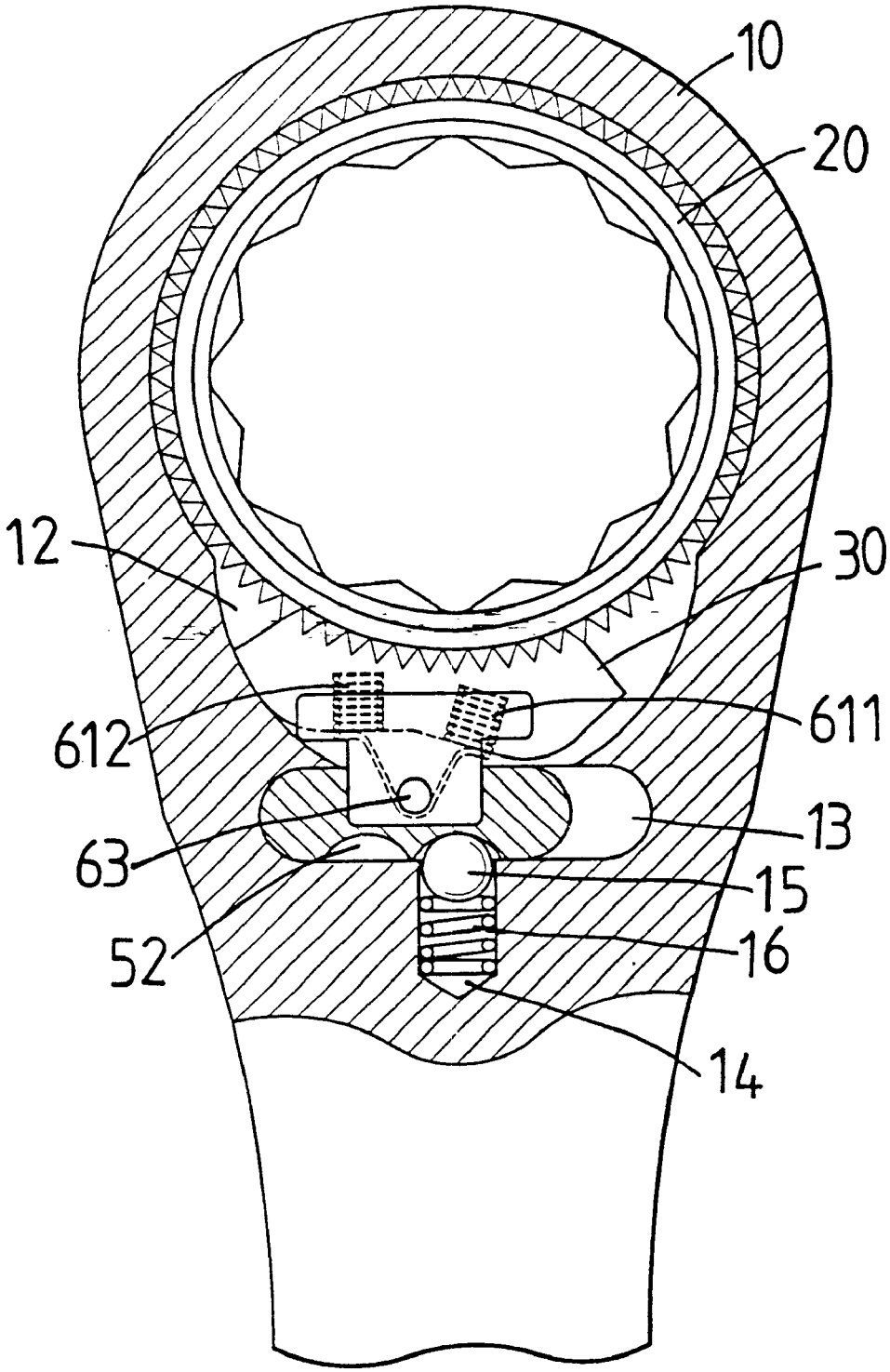
FIG. 3 is a cross sectional view to show the ratchet tool of the present invention, wherein the selection member is moved to the left.
Figure 4:
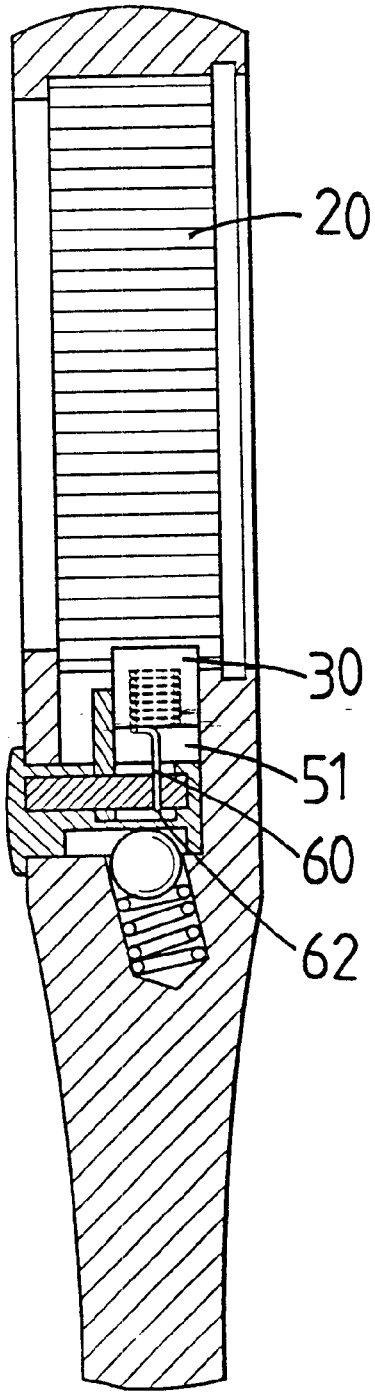
FIG. 4 is a side cross sectional view to show the ratchet tool of the present invention.
Figure 5:
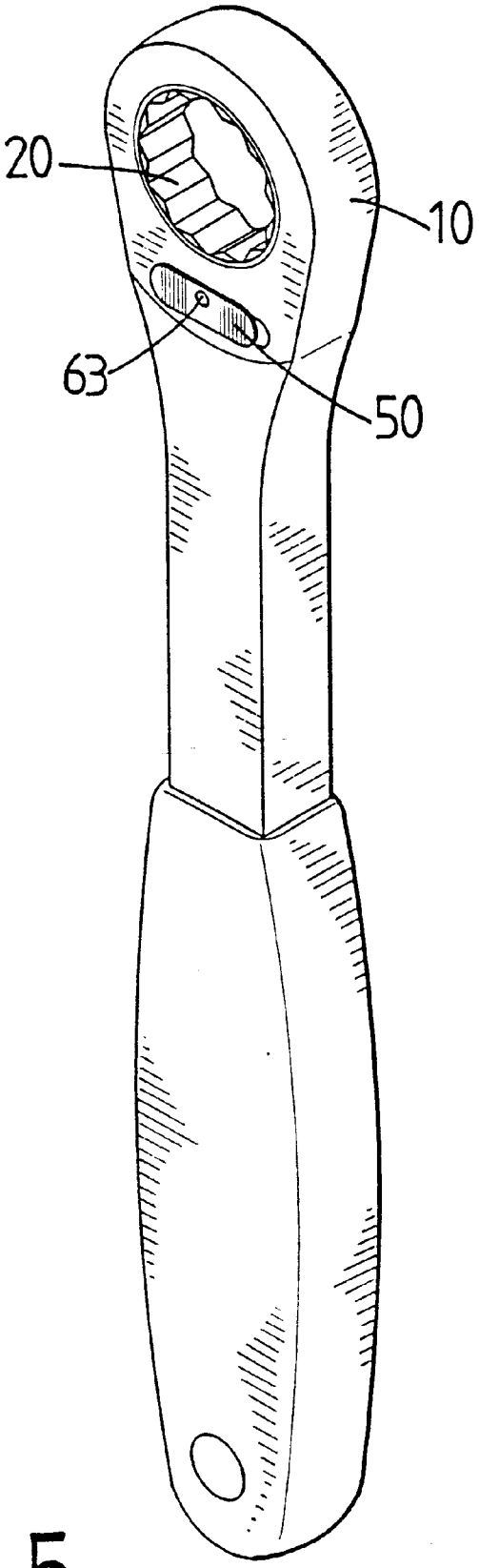
FIG. 5 is a perspective view to show the ratchet tool of the present invention.

Referring to FIG. 3, the selection member 50 can also be pushed to the left and the pawl 30 is then shifted to the left so that the ratchet tool may tight or loosen an object when rotating clockwise.

The selection member 50 can be taken out from the ratchet tool by removing the pin 63 and the spring 16, the bead 15 or the V-shaped spring 60 is conveniently replaced or maintained.

While we have shown and described the embodiment in accordance with the present invention, it should be clear to those skilled in the art that further embodiments may be made without departing from the scope of the present invention.

What is claimed is:

1. A ratchet tool comprising:

a head having a hole defined therethrough and a recess defined in an inner periphery of the hole, a slot defined in a side of the head and communicating with the recess, a notch defined in an inner periphery of the slot;

an engaging member rotatably received in the hole of the head and having a toothed outer periphery;

a pawl movably received in the recess and having a toothed surface defined in a first side of the pawl, the toothed surface matched with the toothed outer periphery of the engaging member, two concavities defined in a second side of the pawl;

a selection member movable in the slot and a bead and a spring received in the notch to position the selection member, and a V-shaped spring secured to the selection member and two distal ends of the V-shaped spring respectively engaged with the two concavities.

2. The ratchet tool as claimed in claim 1, wherein the selection member has a chamber and a mediate portion of the V-shaped spring is securely received in the chamber.

3. The ratchet tool as claimed in claim 2 further comprising a pin extending into the selection member and located between the two distal ends to prevent the spring from being disengaged from the chamber.

4. The ratchet tool as claimed in claim 3 further comprising a plate inserted in the chamber and a hole defined through the plate, the pin extending through the hole.

* * * * *